US012279703B2

(12) United States Patent
Mo

(10) Patent No.: US 12,279,703 B2
(45) Date of Patent: Apr. 22, 2025

(54) BASSINET

(71) Applicant: Zhongshan Youyoubei Daily Products Co., Ltd., Zhongshan (CN)

(72) Inventor: Yijin Mo, Zhongshan (CN)

(73) Assignee: Zhongshan Youyoubei Daily Products Co., Ltd., Zhongshan (CN)

( * ) Notice: Subject to any disclaimer, the term of this patent is extended or adjusted under 35 U.S.C. 154(b) by 292 days.

(21) Appl. No.: 18/094,614

(22) Filed: Jan. 9, 2023

(65) Prior Publication Data

US 2023/0337837 A1 Oct. 26, 2023

(30) Foreign Application Priority Data

Apr. 21, 2022 (CN) ..... 202220939290.6

(51) Int. Cl.
*A47D 9/02* (2006.01)
*A47D 9/00* (2006.01)

(52) U.S. Cl.
CPC ..... *A47D 9/02* (2013.01); *A47D 9/012* (2022.08)

(58) Field of Classification Search
CPC ..... A47D 9/02; A47D 9/012; A47D 9/016
See application file for complete search history.

(56) References Cited

U.S. PATENT DOCUMENTS 5,819,340 A * 10/1998 Kelly ..... A47D 9/016 5/93.1
8,646,129 B1 * 2/2014 Chen ..... A47D 9/02 5/655
2012/0017369 A1 * 1/2012 Li ..... A47D 9/02 5/93.1
2015/0173523 A1 * 6/2015 Horst ..... A47D 9/016 5/655
2016/0000232 A1 * 1/2016 Horst ..... A47D 5/00 5/655
2017/0360216 A1 * 12/2017 Sclare ..... A47D 9/02
2021/0076841 A1 * 3/2021 Hu ..... A47D 9/02
2021/0076842 A1 * 3/2021 Guo ..... A47D 9/016
2023/0200559 A1 * 6/2023 Yang ..... A47D 9/008 5/108

FOREIGN PATENT DOCUMENTS

CN 112956867 A * 6/2021 ..... A47D 9/005
EP 2409605 A1 * 1/2012 ..... A47D 7/04

* cited by examiner

*Primary Examiner* — Myles A Throop
(74) *Attorney, Agent, or Firm* — Ying-Ting Chen

(57) ABSTRACT

The present invention provides a bassinet with at least two left oscillating rods that can make the bed frame assembly swing relative to the connection assembly, and the two left oscillating rods are installed symmetrically with the vertical symmetrical surface of the fence frame, and at least two right oscillating rods are provided that can make the bed frame assembly swing relative to the connection assembly, and the two right oscillating rods are symmetrically installed with the vertical symmetrical surface of the fence frame, which can prevent the bed frame assembly from inclination and ensure the bed frame assembly is horizontally installed on the connection assembly, with the characteristics of stable connection, smooth swing, and high safety.

13 Claims, 8 Drawing Sheets

BASSINET

FIELD OF THE INVENTION

The present invention relates to a bassinet.

BACKGROUND OF THE INVENTION

Baby's bassinet, as a kind of appliance for caring the sleeping babies, has been widely used in families with babies for a long time. When parents swing the baby's bassinet, it not only can hypnotize the baby but also can enhance the relationship between parents and the baby at the same time.

The present baby bassinet usually uses straps to suspend the bed frame on a bracket or connects the bed frame and the bracket rotatably with hinges. However, using the above-mentioned strap or hinge to perform the connection, the strap or hinge will show such as wearing or aging problems due to long-time swinging of the bassinet, resulting in an unstable connection between the bed frame and bracket, which affects the safety of use.

Therefore, the present invention is proposed after studying the problems referred to above.

SUMMARY OF THE INVENTION

The purpose of the present invention is to overcome the insufficiency of the prior art, to provide a bassinet that can improve the existing problems, avoid the inclination of the bed frame assembly, ensure that the bed frame assembly is horizontally mounted on the connection assembly, with the characteristics of stable connection, smooth swing, and high safety.

The present invention is realized by the following technical solutions:

a bassinet, comprising:

a support assembly 1, said support assembly 1 comprising a left supporting rod 11 and a right supporting rod 12 spaced from the left support rod 11;

a connection assembly 2, comprising a left connecting rod sleeve 21 connected at a lower end to the left supporting rod 11 and a right connecting rod sleeve 22 connected at a lower end to the right supporting rod 12;

a bed frame assembly 3, comprising a left connecting seat 31 connected at the upper end of the left connecting rod sleeve 21 and a right connecting seat 32 connected at the upper end of the right connecting rod sleeve 22, said left connecting seat 31 being provided with a fence frame 33 between the left connecting seat 31 and the right connecting seat 32, and the fence frame 33 having a vertical symmetrical surface;

at least two left oscillating rods 311 are provided between the left connecting seat 31 and the left connecting rod sleeve 21 that can make the bed frame assembly 3 swing relative to the connection assembly 2, and the two left oscillating rods 311 are set symmetrically with the vertical symmetrical surface of the fence frame 33, said left oscillating rod 311 is rotatably connected to the left connecting seat 31 at one end and rotatably connected to the left connecting rod sleeve 21 at the other end; and at least two right oscillating rods 321 are provided between the right connecting seat 32 and the right connecting rod sleeve 22 that can make the bed frame assembly 3 swing relative to the connection assembly 2, and the two right oscillating rods 321 are set symmetrically with the vertical symmetrical surface of the fence frame 33, said right oscillating rod 321 is rotatably connected to the right connecting seat 32 at one end and rotatably connected to the right connecting rod sleeve 22 at the other end.

The bassinet as described above is characterized in that the left oscillating rod 311 is rotatably connected to the left connecting seat 31 through a bearing and the left oscillating rod 311 is rotatably connected to the left connecting rod sleeve 21 through a bearing.

The bassinet as described above is characterized in that a left height adjustment structure 4 capable of adjusting the height of the bed frame assembly 3 is provided between the left supporting rod 11 and the left connecting rod sleeve 21, and a right height adjustment structure 5 capable of adjusting the height of the bed frame assembly 3 is provided between the right supporting rod 12 and right connecting rod sleeve 22.

The bassinet as described above is characterized in that the right height adjustment structure 5 includes a plurality of right adjustment holes 51 spaced on the right supporting rod 12, the right connecting rod sleeve 22 is movably provided with a right locking block 52 that can be penetrated into the right adjustment hole 51, the right connecting rod sleeve 22 is movably connected with a right unlocking member 53, which is provided with a right unlocking ramp 531 that can push the right locking block 52 corresponding to the right connecting rod sleeve 22 to move transversely out of the right adjustment hole 51 when the right unlocking member 53 is movable relative to the right connecting rod sleeve 22, a right reset part 532 is provided between the right unlocking member 53 and the right connecting rod sleeve 22 which can drive the right unlocking member 53 to reset, and a right reset member 54 is provided between the right unlocking block 52 and the right connecting rod sleeve 22 which drives the right locking block 52 to reset when the right unlocking ramp 531 withdraws the pushing force on the right locking block 52.

The bassinet as described above is characterized in that a right vertical hole 533 is provided on the right unlocking member 53 for avoiding the right locking block 52, and the right unlocking ramp 531 is correspondingly located on both sides of the right vertical hole 533, so that when the right unlocking member 53 moves upward relative to the right connecting rod sleeve 22, the right unlocking ramp 531 will push against the right locking block 52 to out of the right adjustment hole 51.

The bassinet as described above is characterized in that the support assembly 11 further comprises a left supporting leg 111 connected to the lower end of the left supporting rod 11, wherein the left supporting leg 111 is inverted U-shaped and has a left roller 112 at the lower end; it further comprises a right supporting leg 121 connected to the lower end of the right supporting rod 12, wherein the right supporting leg 121 is provided with a right roller 122 at the lower end.

The bassinet as described above is characterized in that a transverse bar 13 is provided between the left supporting rod 11 and the right supporting rod 12, where the transverse bar 13 is connected to the left supporting rod 11 at one end and connected to the right supporting rod 12 at the other end; and/or the transverse bar 13 is provided between the left supporting leg 111 and the right support leg 121, where the transverse bar 13 is connected to the left supporting leg 111 at one end and connected to the right supporting leg 121 at the other end.

The bassinet as described above is characterized in that a left limiting structure 6 is provided between the left supporting rod 11 and the left connecting rod sleeve 21 to limit the separation of the left supporting rod 11 from the left connecting rod sleeve 21, and a right limiting structure 7 is provided between the right supporting rod 12 and the right connecting rod sleeve 22 to limit the separation of the right supporting rod 12 from the right connecting rod sleeve 22.

The bassinet as described above is characterized in that the bed frame assembly 3 further comprises a bottom frame 34 disposed between the left connecting seat 31 and the right connecting seat 32 and located below the fence frame 33, the bottom frame 34 is connected to the left connecting seat 31 at one end and connected to the right connecting seat 32 at the other end; the fence frame 33 comprises a front rail 331 and a rear rail 332 opposite to the front rail 331, the front rail 331 is connected to the left connection seat 31 at one end and connected to the right connection seat 32 at the other end, the rear rail 332 is connected to the left connection seat 31 at one end and connected to the right connection seat 32 at the other end.

The bassinet as described above is characterized in that the rear rail 332 comprises a first connecting section 3321 connected to a left connecting seat 31 and a right connecting seat 32, respectively, with a second connecting section 3322 between the two sections of the first connecting section 3321, and the first connecting section 3321 and the second connecting section 3322 being provided with a connecting structure 8 for detachably connecting the two; the connecting structure 8 comprising a locking port 81 located on the first connecting section 3321, a locking seat 82 slidingly connected to the second connecting section 3322 capable of entering the locking port 81 to lock the first connecting section 3321 and the second connecting section 3322, an operating member 83 movably connected to the second connecting section 3322 for driving the locking seat 82 to slide relative to the second connecting section 3322, between the second connecting section 3322 and the locking seat 82 are provided with a spring 84 for driving the locking seat 82 to reset.

Compared with the prior art, the present invention has the following advantages:

1. the present invention is provided with at least two left oscillating rods between the left connecting seat and the left connecting rod sleeve that can make the bed frame assembly swing relative to the connection assembly, and the two left oscillating rods are installed symmetrically with the vertical symmetrical surface of the fence frame, where one end of the left oscillating rod is rotatably connected to the left connecting seat, and the other is rotatably connected to the left connecting rod sleeve; at least two right oscillating rods are provided between the right connecting seat and the right connecting rod sleeve that can make the bed frame assembly swing relative to the connection assembly, and the two right oscillating rods are symmetrically installed with the vertical symmetrical surface of the fence frame, where one end of the right oscillating rod is rotatably connected with the right connecting seat, and the other end is rotatably connected with the right connecting rod sleeve, which can prevent the bed frame assembly from inclination and ensure the bed frame assembly is horizontally installed on the connection assembly, with the characteristics of stable connection, smooth swing, and high safety;
2. Between the left supporting rod and the left connecting rod sleeve are provided with the left height adjustment structure that can adjust the height of the bed frame assembly, and between the right supporting rod and the right connecting rod sleeve are provided with the right height adjustment structure that can adjust the height of the bed frame assembly, therefore, the present invention can adjust the height of the bed frame assembly according to the requirements, and has the characteristics of stable and convenient adjustment and is easy to use;
3. The right unlocking member is provided with the right vertical hole for avoiding the right locking block, and the right unlocking ramp is correspondingly located on both sides of the right vertical hole, which can play the role of avoiding to avoid the jam, while the wall of the right vertical hole can restrict the right locking block from shaking in the process of movement and ensure the stable movement of the right locking block, thus ensuring that the right locking block is accurately inserted into the right adjustment hole; and
4. Between the first connecting section and the second connecting section are provided with the connecting structure so that they can be detachably connected. In use, the user operates the connecting structure to detach the second connecting section from the first connecting section, so that a gap is formed between the two first connection sections to facilitate the user putting the baby into the bed frame assembly or carrying the baby out of the bed frame assembly.

BRIEF DESCRIPTION OF THE DRAWINGS

The specific embodiments of the present invention are described in further detail below in conjunction with the accompanying drawings, wherein.

DESCRIPTION OF THE PREFERRED EMBODIMENTS

The following is a detailed description of the embodiments of the present invention in conjunction with the accompanying drawings.

Figure 1:
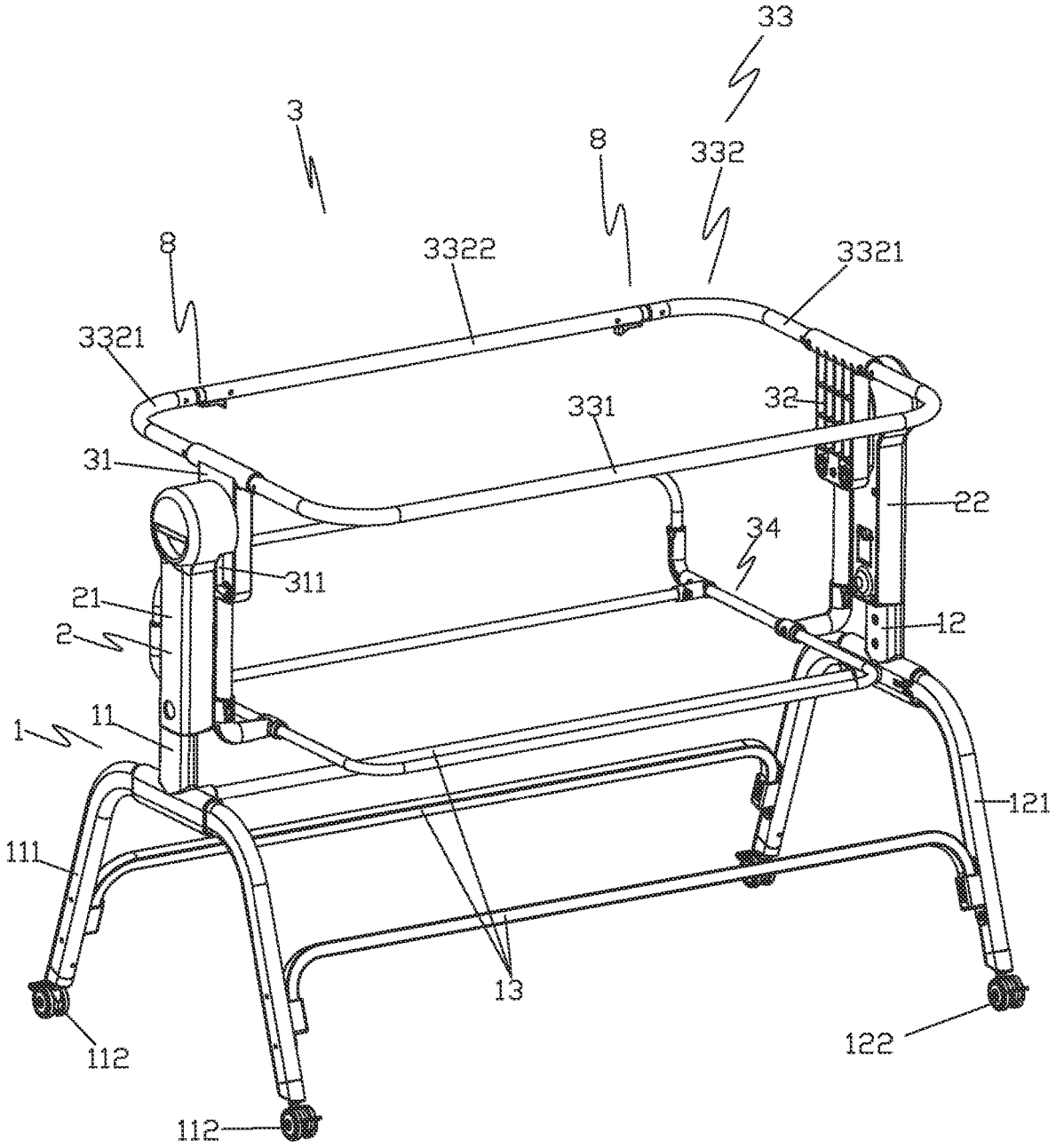
FIG. 1 is the first three-dimensional diagram of the present invention.
Figure 2:
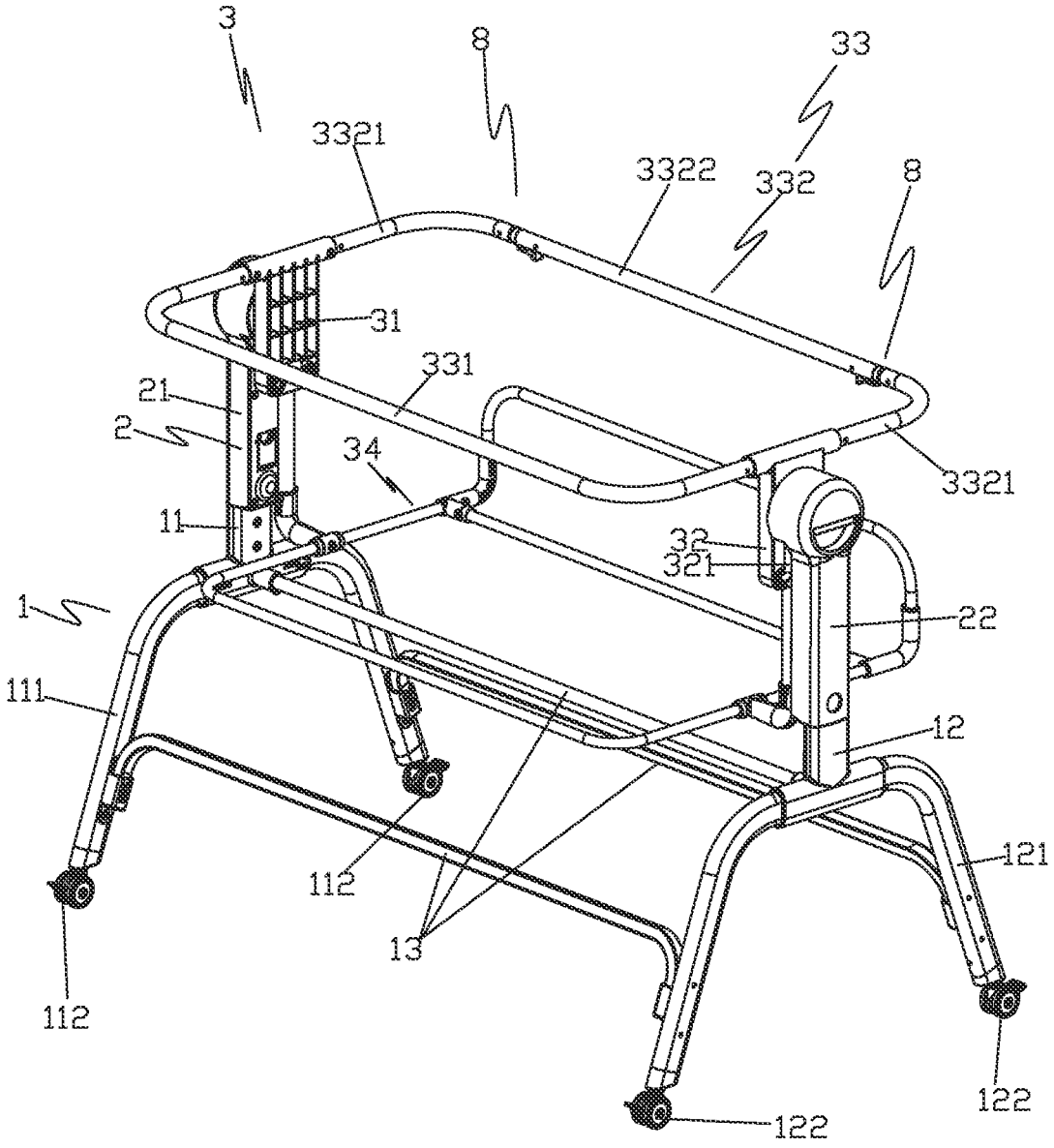
FIG. 2 is the second three-dimensional diagram of the present invention.
Figure 3:
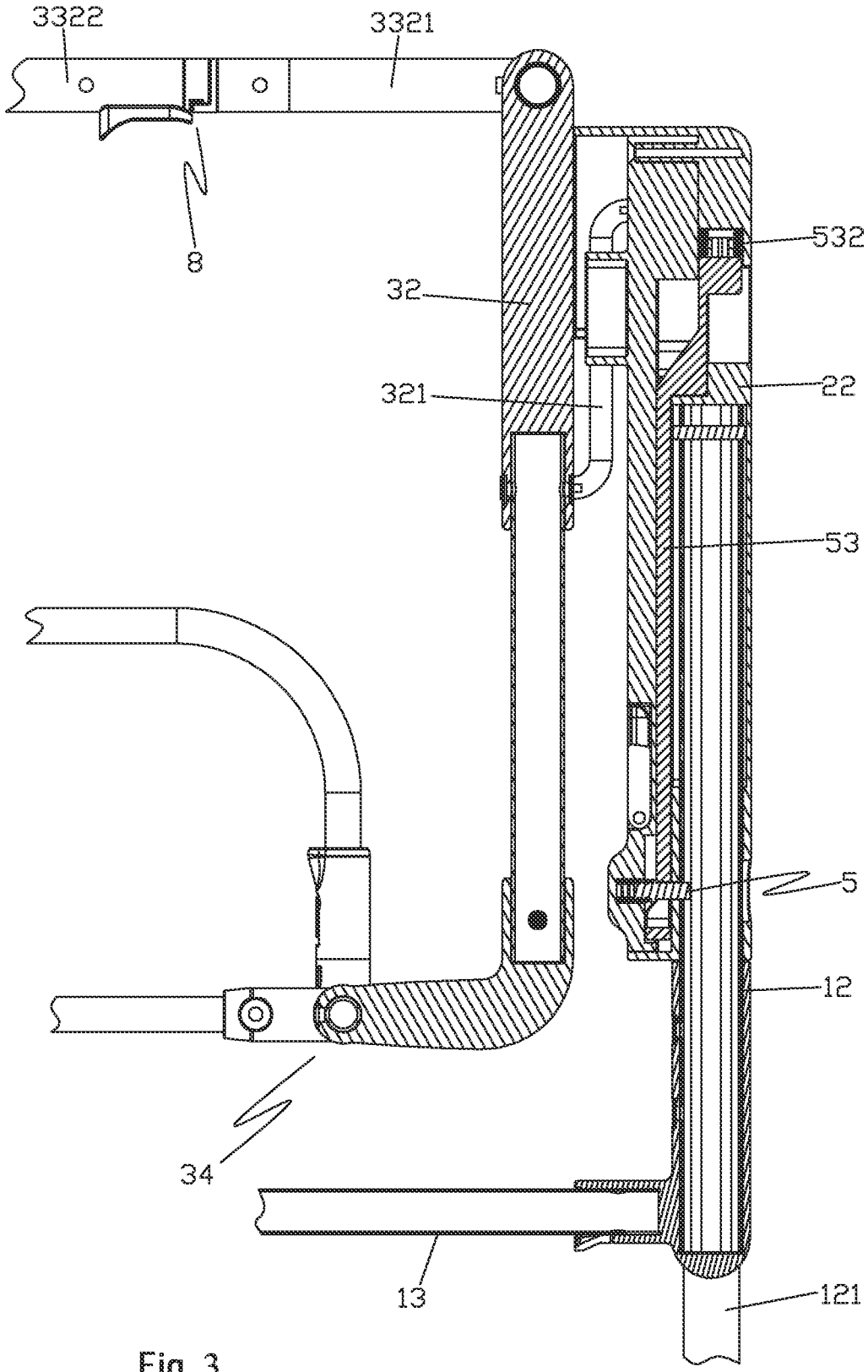
FIG. 3 is the first cross-sectional view of the right height adjustment structure of the present invention.
Figure 4:
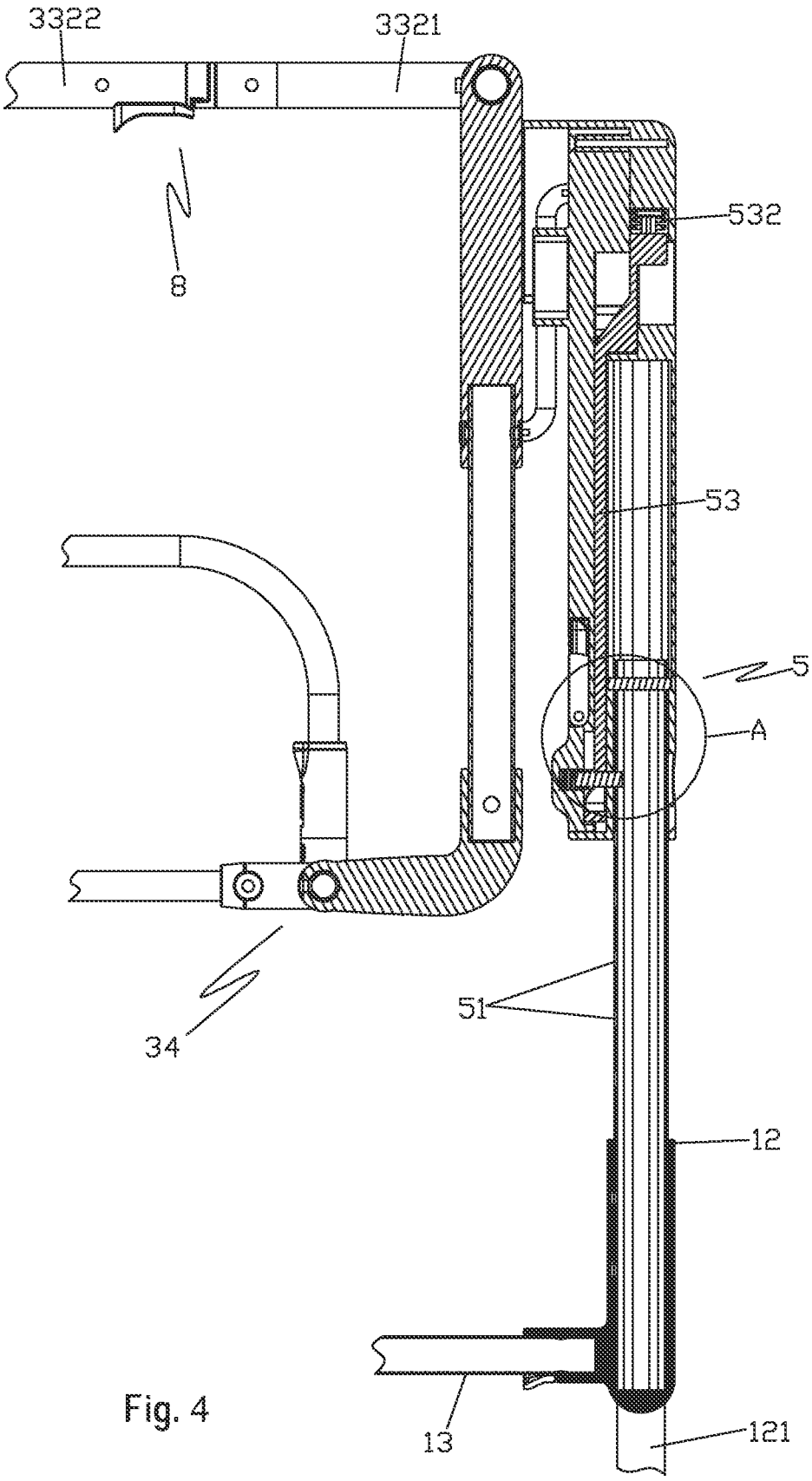
FIG. 4 is the second cross-sectional view of the right height adjustment structure of the present invention.
Figure 5:
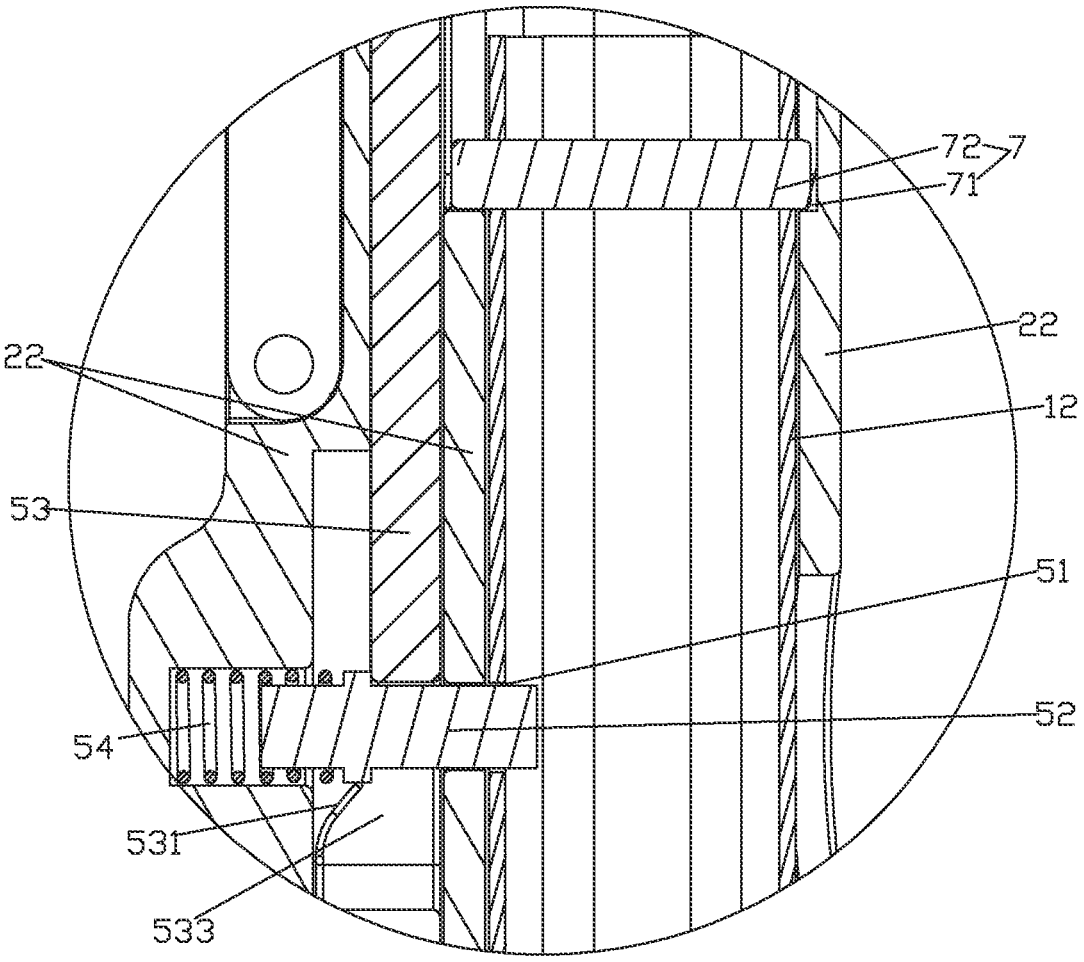
FIG. 5 is an enlarged schematic diagram of A in FIG. 4.
Figure 6:
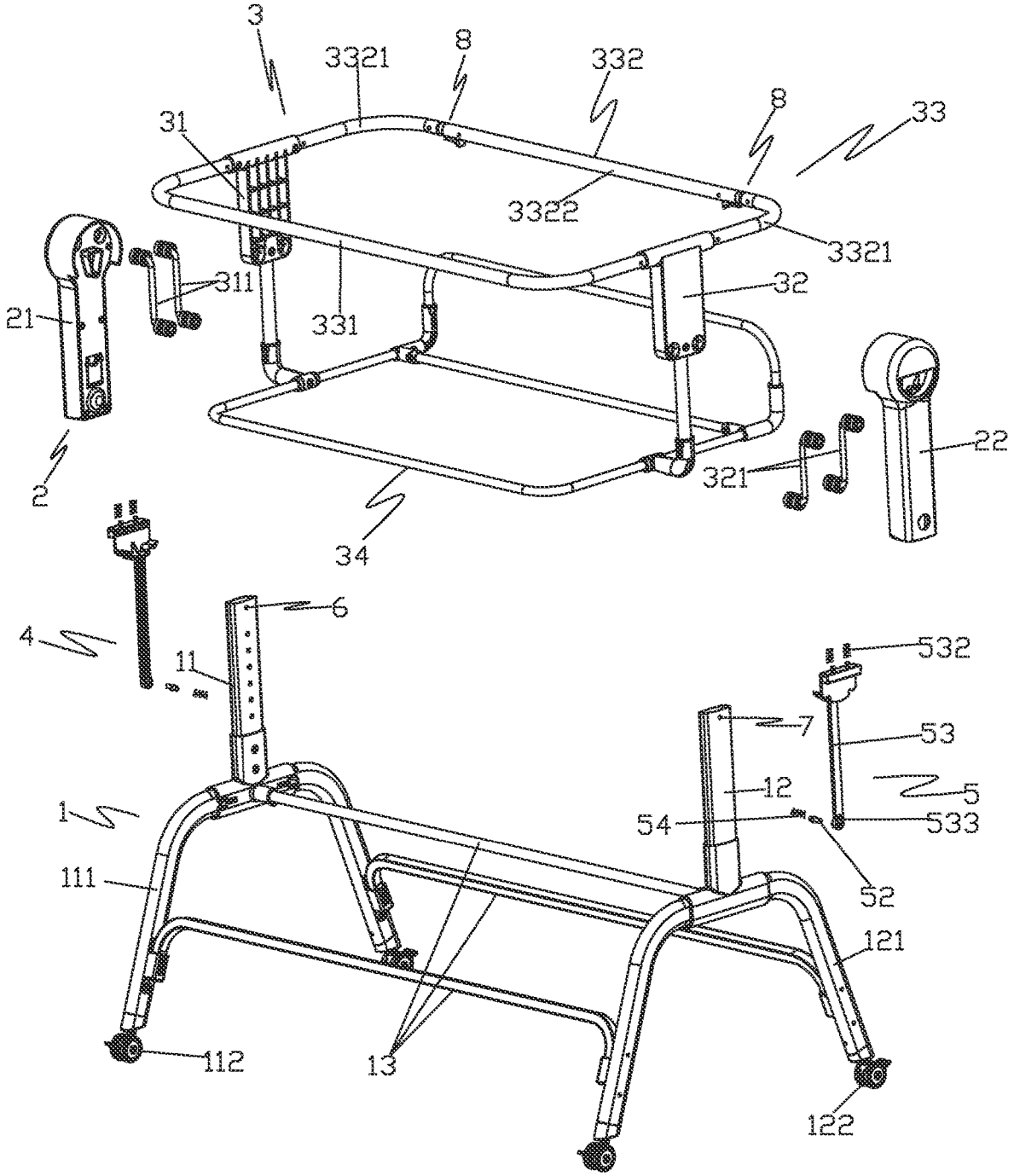
FIG. 6 is an exploded view of the present invention.
Figure 7:
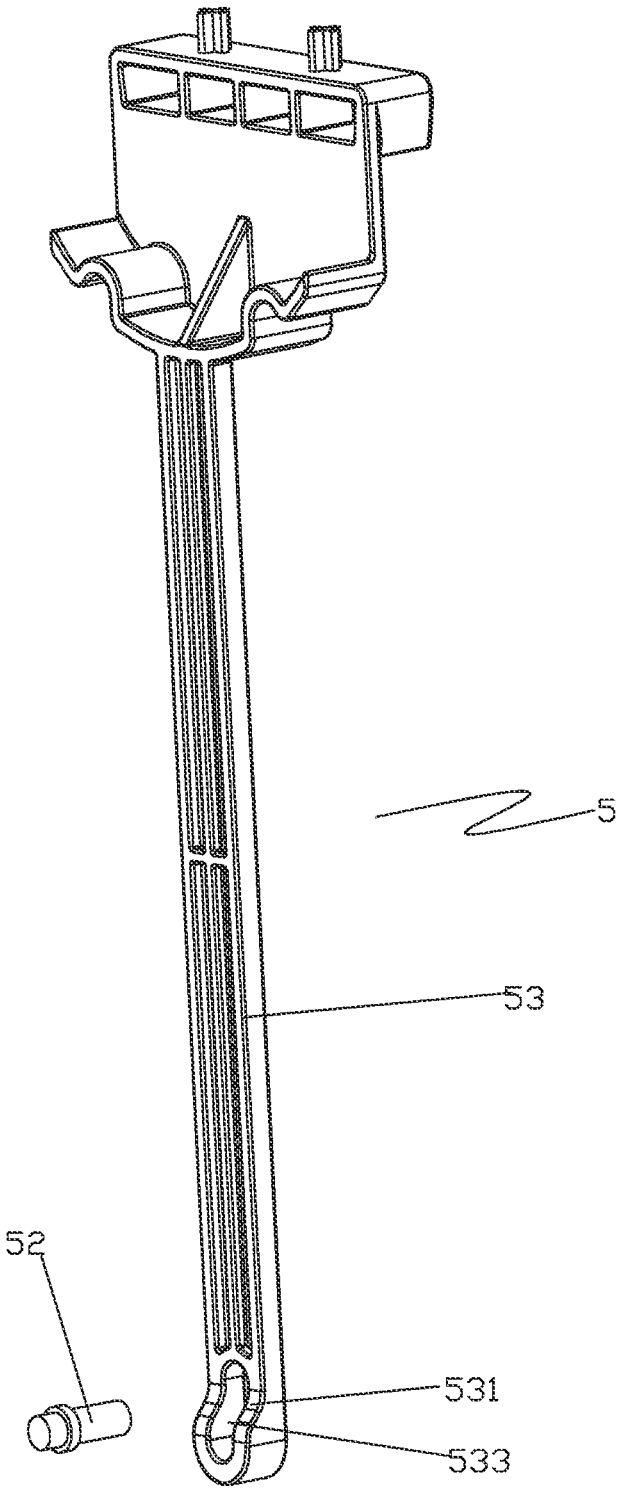
FIG. 7 is an element diagram of the right height adjustment structure of the present invention.
Figure 8:
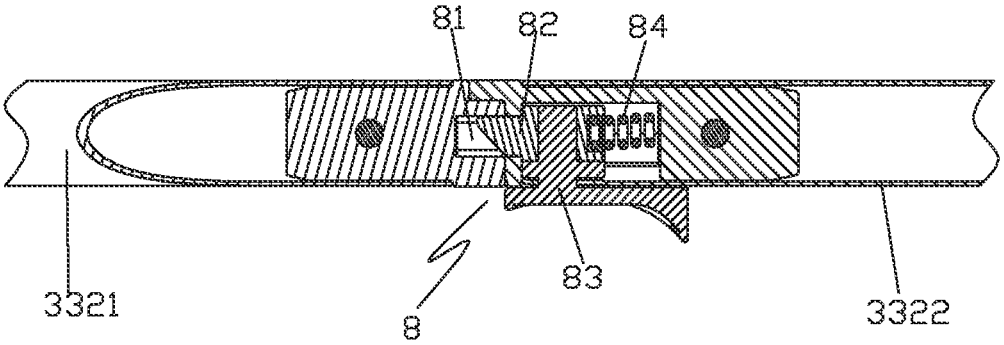
FIG. 8 is a cross-sectional view of the connecting structure of the present invention.

As shown in FIGS. 1-8, a bassinet of the present invention, comprising:

a support assembly 1, said support assembly 1 comprising a left supporting rod 11 and a right supporting rod 12 spaced from the left support rod 11;

a connection assembly 2, comprising a left connecting rod sleeve 21 connected at a lower end to the left supporting rod 11 and a right connecting rod sleeve 22 connected at a lower end to the right supporting rod 12;

a bed frame assembly 3, comprising a left connecting seat 31 connected at the upper end of the left connecting rod sleeve 21 and a right connecting seat 32 connected at the upper end of the right connecting rod sleeve 22, said left connecting seat 31 being provided with a fence frame 33 between the left connecting seat 31 and the right connecting seat 32, and the fence frame 33 having a vertical symmetrical surface;

at least two left oscillating rods 311 are provided between the left connecting seat 31 and the left connecting rod sleeve 21 that can make the bed frame assembly 3 swing relative to the connection assembly 2, and the two left oscillating rods 311 are set symmetrically with the vertical symmetrical surface of the fence frame 33, said left oscillating rod 311 is rotatably connected to the left connecting seat 31 at one end and rotatably connected to the left connecting rod sleeve 21 at the other end; and at least two right oscillating rods 321 are provided between the right connecting seat 32 and the right connecting rod sleeve 22 that can make the bed frame assembly 3 swing relative to the connection assembly 2, and the two right oscillating rods 321 are set symmetrically with the vertical symmetrical surface of the fence frame 33, said right oscillating rod 321 is rotatably connected to the right connecting seat 32 at one end and rotatably connected to the right connecting rod sleeve 22 at the other end.

The present invention is provided with at least two left oscillating rods between the left connecting seat and the left connecting rod sleeve that can make the bed frame assembly swing relative to the connection assembly, and the two left oscillating rods are installed symmetrically with the vertical symmetrical surface of the fence frame, where one end of the left oscillating rod is rotatably connected to the left connecting seat, and the other is rotatably connected to the left connecting rod sleeve; at least two right oscillating rods are provided between the right connecting seat and the right connecting rod sleeve that can make the bed frame assembly swing relative to the connection assembly, and the two right oscillating rods are symmetrically installed with the vertical symmetrical surface of the fence frame, where one end of the right oscillating rod is rotatably connected with the right connecting seat, and the other end is rotatably connected with the right connecting rod sleeve, which can prevent the bed frame assembly from inclination and ensure the bed frame assembly is horizontally installed on the connection assembly, with the characteristics of stable connection, smooth swing, and high safety.

As shown in FIGS. 1-8, in order to make the bed frame assembly swing more smoothly, the left oscillating rod 311 is rotatably connected to the left connecting seat 31 through a bearing and the left oscillating rod 311 is rotatably connected to the left connecting rod sleeve 21 through a bearing, correspondingly the right oscillating rod 321 is rotatably connected to the right connecting seat 32 through a bearing, and the right oscillating rod 321 is rotatably connected to right connecting rod sleeve 22 through a bearing.

As shown in FIGS. 1-8, a left height-adjustment structure 4 capable of adjusting the height of the bed frame assembly 3 is provided between the left supporting rod 11 and the left connecting rod sleeve 21, and a right height adjustment structure 5 capable of adjusting the height of the bed frame assembly 3 is provided between the right supporting rod 12 and right connecting rod sleeve 22. Therefore, the present invention can adjust the height of the bed frame assembly according to the requirements, and has the characteristics of stable and convenient adjustment, and is easy to use. In this embodiment, the structure of the left height adjustment structure 4 is the same as that of the right height adjustment structure 5 and is not described herein.

As shown in FIGS. 1-8, the right height adjustment structure 5 includes a plurality of right adjustment holes 51 spaced on the right supporting rod 12, the right connecting rod sleeve 22 is movably provided with a right locking block 52 that can be penetrated into the right adjustment hole 51, the right connecting rod sleeve 22 is movably connected with a right unlocking member 53, which is provided with a right unlocking ramp 531 that can push the right locking block 52 corresponding to the right connecting rod sleeve 22 to move transversely out of the right adjustment hole 51 when the right unlocking member 53 is movable relative to the right connecting rod sleeve 22, a right reset part 532 is provided between the right unlocking member 53 and the right connecting rod sleeve 22 which can drive the right unlocking member 53 to reset, and a right reset member 54 is provided between the right unlocking block 52 and the right connecting rod sleeve 22 which drives the right locking block 52 to reset when the right unlocking ramp 531 withdraws the pushing force on the right locking block 52.

During the adjustment, the user operates the right unlocking member 53 to move upward relative to the right connecting rod sleeve 22, and during the above movement, the right unlocking ramp 531 pushes the right locking block 52 to move transversely relative to the right connecting rod sleeve 22 and causes the right locking block 52 out of the right adjustment hole 51, so as to unlock the right connecting rod sleeve 22 and the right supporting rod 12. At this time, the user can operate the right connecting rod sleeve 22 to adjust the height of the bed frame assembly 3 by moving up or down relative to the right supporting rod 12. When the desired height is adjusted, the user can withdraw the force on the right unlocking member 53, then the right reset part 532 will drive the right unlocking member 53 to reset downwardly, thus the right unlocking ramp 531 will withdraw the pushing force on the right locking block 52, the right reset member 54 will drive the end of the right locking block 52 insert into the right adjustment hole 51 and locks the right connecting rod sleeve 22 and the right supporting rod 12, thus completing the adjustment work, which has the characteristics of convenient operation and stable adjustment.

To improve the reset effect, the right reset part 532 and right reset member 54 are both springs.

As shown in FIGS. 1-8, a right vertical hole 533 is provided on the right unlocking member 53 for avoiding the right locking block 52, and the right unlocking ramp 531 is correspondingly located on both sides of the right vertical hole 533, so that when the right unlocking member 53 moves upward relative to the right connecting rod sleeve 22, the right unlocking ramp 531 will push against the right locking block 52 to out of the right adjustment hole 51, which can play the role of avoiding to avoid the jam, while the wall of the right vertical hole can restrict the right locking block from shaking in the process of movement and ensure the stable movement of the right locking block, thus ensuring that the right locking block is accurately inserted into the right adjustment hole.

As shown in FIGS. 1-8, for ease of movement and improved stability, the support assembly 11 further comprises a left supporting leg 111 connected to the lower end of the left supporting rod 11, wherein the left supporting leg 111 is inverted U-shaped and has a left roller 112 at the lower end, it further comprises a right supporting leg 121 connected to the lower end of the right supporting rod 12, wherein the right supporting leg 121 is provided with a right roller 122 at the lower end.

As shown in FIGS. 1-8, in order to improve the connection strength, a transverse bar 13 is provided between the left supporting rod 11 and the right supporting rod 12, where the transverse bar 13 is connected to the left supporting rod 11 at one end and connected to the right supporting rod 12 at the other end; and/or the transverse bar 13 is provided between the left supporting leg 111 and the right support leg 121, where the transverse bar 13 is connected to the left supporting leg 111 at one end and connected to the right supporting leg 121 at the other end.

As shown in FIGS. 1-8, in order to make the present invention structure stable, a left limiting structure 6 is provided between the left supporting rod 11 and the left connecting rod sleeve 21 to limit the separation of the left supporting rod 11 from the left connecting rod sleeve 21, and a right limiting structure 7 is provided between the right supporting rod 12 and the right connecting rod sleeve 22 to limit the separation of the right supporting rod 12 from the right connecting rod sleeve 22. The structure of the left limiting structure 6 is the same as the structure of the right limiting structure 7 and is not described herein As shown in FIGS. 1-8, in order to better limit and ensure a stable connection between the right supporting rod 12 and the right connecting rod sleeve 22, the right limiting structure 7 includes a right limiting recess 71 located on the right connecting rod sleeve 22, and the right supporting rod 12 is provided with a right limiting rod 72 that can move in the right limiting recess 71 and can limit with the side wall of the right limiting recess 71.

As shown in FIGS. 1-8, the bed frame assembly 3 further comprises a bottom frame 34 disposed between the left connecting seat 31 and the right connecting seat 32 and located below the fence frame 33, the bottom frame 34 is connected to the left connecting seat 31 at one end and connected to the right connecting seat 32 at the other end, the fence frame 33 comprises a front rail 331 and a rear rail 332 opposite to the front rail 331, the front rail 331 is connected to the left connection seat 31 at one end and connected to the right connection seat 32 at the other end, the rear rail 332 is connected to the left connection seat 31 at one end and connected to the right connection seat 32 at the other end.

As shown in FIGS. 1-8, the rear rail 332 comprises a first connecting section 3321 connected to a left connecting seat 31 and a right connecting seat 32, respectively, with a second connecting section 3322 between the two sections of the first connecting section 3321, and the first connecting section 3321 and the second connecting section 3322 being provided with a connecting structure 8 for detachably connecting the two. In use, the user operates the connecting structure to detach the second connecting section from the first connecting section, so that a gap is formed between the two first connection sections to facilitate the user putting the baby into the bed frame assembly or carrying the baby out of the bed frame assembly. In other embodiments, for greater ease of use, one end of the second connecting section 3322 is connected to the first connecting section 3321 through the connecting structure 8, and one end of the second connecting section 3322 is rotatably connected to another first connecting section 3321.

As shown in FIGS. 1-8, the connecting structure 8 comprising a locking port 81 located on the first connecting section 3321, a locking seat 82 slidingly connected to the second connecting section 3322 capable of entering the locking port 81 to lock the first connecting section 3321 and the second connecting section 3322, an operating member 83 movably connected to the second connecting section 3322 for driving the locking seat 82 to slide relative to the second connecting section 3322, between the second connecting section 3322 and the locking seat 82 are provided with a spring 84 for driving the locking seat 82 to reset. In use, the user operates the operating member 83 driving the locking seat 82 to slide relative to the second connection section 3322, i.e., driving the locking seat 82 to move away from the locking port 81, which makes the locking seat 82 out of the locking port 81, at which time the second connecting section 3322 can be separated from the first connecting section 3321.

What is claimed is:

1. A bassinet is characterized in that it comprises:

a support assembly (1), said support assembly (1) comprising a left supporting rod (11) and a right supporting rod (12) spaced from the left support rod (11);

a connection assembly (2), comprising a left connecting rod sleeve (21) connected at a lower end to the left supporting rod (11) and a right connecting rod sleeve (22) connected at a lower end to the right supporting rod (12);

a bed frame assembly (3), comprising a left connecting seat (31) connected at the upper end of the left connecting rod sleeve (21) and a right connecting seat (32) connected at the upper end of the right connecting rod sleeve (22), said left connecting seat (31) being provided with a fence frame (33) between the left connecting seat (31) and the right connecting seat (32), and the fence frame (33) having a vertical symmetrical surface;

at least two left oscillating rods (311) are provided between the left connecting seat (31) and the left connecting rod sleeve (21) that can make the bed frame assembly (3) swing relative to the connection assembly (2), and the two left oscillating rods (311) are set symmetrically with the vertical symmetrical surface of the fence frame (33), each of the left oscillating rods (311) is rotatably connected to the left connecting seat (31) at one end and rotatably connected to the left connecting rod sleeve (21) at the other end; and at least two right oscillating rods (321) are provided between the right connecting seat (32) and the right connecting rod sleeve (22) that can make the bed frame assembly (3) swing relative to the connection assembly (2), and the two right oscillating rods (321) are set symmetrically with the vertical symmetrical surface of the fence frame (33), each of the right oscillating rods (321) is rotatably connected to the right connecting seat (32) at one end and rotatably connected to the right connecting rod sleeve (22) at the other end;

wherein a left limiting structure (6) is provided between the left supporting rod (11) and the left connecting rod sleeve (21) to limit the separation of the left supporting rod (11) from the left connecting rod sleeve (21), and a right limiting structure (7) is provided between the right supporting rod (12) and the right connecting rod sleeve (22) to limit the separation of the right supporting rod (12) from the right connecting rod sleeve (22).

2. The bassinet according to claim 1, is characterized in that the left oscillating rod (311) is rotatably connected to the left connecting seat (31) through a bearing and the left oscillating rod (311) is rotatably connected to the left connecting rod sleeve (21) through a bearing.

3. The bassinet according to claim 1, is characterized in that a left height adjustment structure (4) capable of adjusting the height of the bed frame assembly (3) is provided between the left supporting rod (11) and the left connecting rod sleeve (21), and a right height adjustment structure (5)

capable of adjusting the height of the bed frame assembly (3) is provided between the right supporting rod (12) and right connecting rod sleeve (22).

4. The bassinet according to claim 3, is characterized in that the right height adjustment structure (5) includes a plurality of right adjustment holes (51) spaced on the right supporting rod (12), the right connecting rod sleeve (22) is movably provided with a right locking block (52) that can be penetrated into the right adjustment hole (51), the right connecting rod sleeve (22) is movably connected with a right unlocking member (53), which is provided with a right unlocking ramp (531) that can push the right locking block (52) corresponding to the right connecting rod sleeve (22) to move transversely out of the right adjustment hole (51) when the right unlocking member (53) is movable relative to the right connecting rod sleeve (22), a right reset part (532) is provided between the right unlocking member (53) and the right connecting rod sleeve (22) which can drive the right unlocking member (53) to reset, and a right reset member (54) is provided between the right unlocking block (52) and the right connecting rod sleeve (22) which drives the right locking block (52) to reset when the right unlocking ramp (531) withdraws the pushing force on the right locking block (52).

5. The bassinet according to claim 4, is characterized in that a right vertical hole (533) is provided on the right unlocking member (53) for avoiding the right locking block (52), and the right unlocking ramp (531) is correspondingly located on both sides of the right vertical hole (533), so that when the right unlocking member (53) moves upward relative to the right connecting rod sleeve (22), the right unlocking ramp (531) will push against the right locking block (52) to out of the right adjustment hole (51).

6. The bassinet according to claim 5, is characterized in that the bed frame assembly (3) further comprises a bottom frame (34) disposed between the left connecting seat (31) and the right connecting seat (32) and located below the fence frame (33), the bottom frame (34) is connected to the left connecting seat (31) at one end and connected to the right connecting seat (32) at the other end;

the fence frame (33) comprises a front rail (331) and a rear rail (332) opposite to the front rail (331), the front rail (331) is connected to the left connection seat (31) at one end and connected to the right connection seat (32) at the other end, the rear rail (332) is connected to the left connection seat (31) at one end and connected to the right connection seat (32) at the other end.

7. The bassinet according to claim 6, is characterized in that the rear rail (332) comprises a first connecting section (3321) connected to the left connecting seat (31) and the right connecting seat (32) respectively, with a second connecting section (3322) between the two sections of the first connecting section (3321), and the first connecting section (3321) and the second connecting section (3322) being provided with a connecting structure (8) for detachably connecting the two;

the connecting structure (8) comprising a locking port (81) located on the first connecting section (3321), a locking seat (82) slidingly connected to the second connecting section (3322) capable of entering the locking port (81) to lock the first connecting section (3321) and the second connecting section (3322), an operating member 83 movably connected to the second connecting section (3322) for driving the locking seat (82) to slide relative to the second connecting section (3322), between the second connecting section (3322) and the locking seat (82) are provided with a spring (84) for driving the locking seat (82) to reset.

8. The bassinet according to claim 4, is characterized in that the bed frame assembly (3) further comprises a bottom frame (34) disposed between the left connecting seat (31) and the right connecting seat (32) and located below the fence frame (33), the bottom frame (34) is connected to the left connecting seat (31) at one end and connected to the right connecting seat (32) at the other end;

the fence frame (33) comprises a front rail (331) and a rear rail (332) opposite to the front rail (331), the front rail (331) is connected to the left connection seat (31) at one end and connected to the right connection seat (32) at the other end, the rear rail (332) is connected to the left connection seat (31) at one end and connected to the right connection seat (32) at the other end.

9. The bassinet according to claim 1, is characterized in that the support assembly (11) further comprises a left supporting leg (111) connected to the lower end of the left supporting rod (11), wherein the left supporting leg (111) is inverted U-shaped and has a left roller (112) at the lower end; it further comprises a right supporting leg (121) connected to the lower end of the right supporting rod (12), wherein the right supporting leg (121) is provided with a right roller (122) at the lower end.

10. The bassinet according to claim 9, is characterized in that a transverse bar (13) is provided between the left supporting rod (11) and the right supporting rod (12), where the transverse bar (13) is connected to the left supporting rod (11) at one end and connected to the right supporting rod (12) at the other end; and/or the transverse bar (13) is provided between the left supporting leg (111) and the right support leg (121), where the transverse bar (13) is connected to the left supporting leg (111) at one end and connected to the right supporting leg (121) at the other end.

11. The bassinet according to claim 10, is characterized in that the bed frame assembly (3) further comprises a bottom frame (34) disposed between the left connecting seat (31) and the right connecting seat (32) and located below the fence frame (33), the bottom frame (34) is connected to the left connecting seat (31) at one end and connected to the right connecting seat (32) at the other end;

the fence frame (33) comprises a front rail (331) and a rear rail (332) opposite to the front rail (331), the front rail (331) is connected to the left connection seat (31) at one end and connected to the right connection seat (32) at the other end, the rear rail (332) is connected to the left connection seat (31) at one end and connected to the right connection seat (32) at the other end.

12. The bassinet according to claim 9, is characterized in that the bed frame assembly (3) further comprises a bottom frame (34) disposed between the left connecting seat (31) and the right connecting seat (32) and located below the fence frame (33), the bottom frame (34) is connected to the left connecting seat (31) at one end and connected to the right connecting seat (32) at the other end;

the fence frame (33) comprises a front rail (331) and a rear rail (332) opposite to the front rail (331), the front rail (331) is connected to the left connection seat (31) at one end and connected to the right connection seat (32) at the other end, the rear rail (332) is connected to the left connection seat (31) at one end and connected to the right connection seat (32) at the other end.

13. The bassinet according to claim 1, is characterized in that the bed frame assembly (3) further comprises a bottom frame (34) disposed between the left connecting seat (31) and the right connecting seat (32) and located below the fence frame (33), the bottom frame (34) is connected to the left connecting seat (31) at one end and connected to the right connecting seat (32) at the other end;

the fence frame (33) comprises a front rail (331) and a rear rail (332) opposite to the front rail (331), the front rail (331) is connected to the left connection seat (31) at one end and connected to the right connection seat (32) at the other end, the rear rail (332) is connected to the left connection seat (31) at one end and connected to the right connection seat (32) at the other end.

* * * * *